US008441308B2

(12) United States Patent
Arnold et al.

(10) Patent No.: US 8,441,308 B2
(45) Date of Patent: May 14, 2013

(54) BIAS CURRENT GENERATOR

(75) Inventors: Matthias Arnold, Freising (DE); Johannes Gerber, Unterschleissheim (DE)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 12/147,048

(22) Filed: Jun. 26, 2008

(65) Prior Publication Data

US 2009/0039945 A1 Feb. 12, 2009

Related U.S. Application Data

(60) Provisional application No. 61/016,732, filed on Dec. 26, 2007.

(30) Foreign Application Priority Data

Jul. 9, 2007 (DE) ..... 10 2007 031 902

(51) Int. Cl.
*G05F 1/10* (2006.01)

(52) U.S. Cl.
USPC ..... 327/538; 327/512

(58) Field of Classification Search ..... 327/512, 327/513, 538, 539
See application file for complete search history.

(56) References Cited

U.S. PATENT DOCUMENTS

| | | | | |
|---|---|---|---|---|
| 6,087,820 | A | 7/2000 | Houghton et al. | |
| 6,690,228 | B1 | 2/2004 | Chen et al. | |
| 6,744,304 | B2 | 6/2004 | Egerer et al. | |
| 6,982,590 | B2 * | 1/2006 | Seshita | 327/539 |
| 7,495,505 | B2 * | 2/2009 | Chang et al. | 327/539 |
| 7,541,862 | B2 * | 6/2009 | Fujisawa et al. | 327/539 |
| 7,570,107 | B2 * | 8/2009 | Kim et al. | 327/539 |
| 2005/0134365 | A1 | 6/2005 | Kimura | |
| 2005/0285676 | A1 | 12/2005 | Jones | |

FOREIGN PATENT DOCUMENTS

DE 10 143 032 A1 4/2003

OTHER PUBLICATIONS

Tietze/Schenk; Halbleiterschaltungstechnik (semiconductor circuit engineering), 10th Ed., 1997, pp. 122-124 and 122-133.

* cited by examiner

*Primary Examiner* — Jeffrey Zweizig
(74) *Attorney, Agent, or Firm* — Robert D. Marshall, Jr.; Wade James Brady, III; Frederick J. Telecky, Jr.

(57) ABSTRACT

An electronic device generates a current with a predetermined temperature coefficient. The circuit comprises a temperature coefficient (TC) component receiving a bias current, a differential amplifier providing a buffered output voltage based on the voltage across the TC component and a resistor receiving an TC current based on the differential amplifier output voltage. The differential amplifier has a predetermined input related offset which decreases the voltage drop across the resistor. The temperature coefficient component could have either a negative temperature component (NTC) or a positive temperature component (PTC).

11 Claims, 2 Drawing Sheets

BIAS CURRENT GENERATOR

CLAIM OF PRIORITY

This application claims priority under 35 U.S.C. 119(a) to German Patent Application No. 10 2007 031 902.0 filed Jul. 9, 2007 and 35 U.S.C. 119(e)(1) to U.S. Provisional Application No. 61/016,732 filed Dec. 26, 2007.

TECHNICAL FIELD OF THE INVENTION

The technical field of this invention is an electronic device comprising circuitry for generating a bias current with a defined temperature coefficient (TC) and a corresponding method.

BACKGROUND OF THE INVENTION

Integrated electronic circuits need all kinds of bias current or voltage generating stages. In order to provide specific temperature dependent effects and to compensate for temperature dependent behavior of the circuitry, bias current or bias voltage generators with positive or negative temperature coefficients (PTC, NTC) are used. The resistance of a device with an NTC decreases with rising temperature. Typically, these NTC-based current generators are combined with components having a positive temperature coefficient (PTC) having together reduced or no temperature dependency. One prior art solution for generating an NTC current uses a feedback loop to force a base-emitter voltage ($V_{BE}$) of a bipolar transistor or a forward voltage of a diode across a resistor. This causes the current through the resistor to have the NTC of the bipolar transistor's base emitter voltage $V_{BE}$. If the feedback circuitry should have very low power consumption, the resistance of the resistor should be very large or the $V_{BE}$ has to be very small. However, the range and the flexibility of $V_{BE}$ is very restricted and it typically amounts to 700 to 800 mV resulting in a resistance of several MΩ for a target current of several hundred nA. A resistor having such a high resistance requires a lot of chip area if implemented as a typical sheet resistor.

SUMMARY OF THE INVENTION

It is an object of the present invention to provide an electronic device including circuitry for generating a current with a specific temperature coefficient requiring less chip area and less power consumption than the prior art.

According to an aspect of the present invention, an electronic device includes circuitry for generating a current with a predetermined temperature coefficient (TC). For example, the circuitry includes an NTC component coupled to receive a bias current, a differential amplifier connected so as to buffer a voltage across the NTC component for providing a buffered output voltage based on the voltage across the NTC component, a resistor connected so as to receive an NTC current based on the differential amplifier output voltage, wherein the differential amplifier has a predetermined input related offset, so as to decrease the voltage drop across the resistor. Accordingly, in this aspect of the present invention the differential amplifier used to buffer the voltage having a negative temperature coefficient has an offset, such that the output voltage is systematically reduced allowing a smaller resistor value to be used for the resistor coupled to the output of the differential amplifier. This principle is also applicable to a PTC component.

An input related offset can be implemented in many different ways in the differential amplifier. For example, the differential input pair of a differential amplifier implemented in a CMOS technology can be dimensioned such that one of the transistors of the differential pair has a substantially larger width or a larger width to length ratio than the other transistor. Using a ratio of an integer factor N of the width of the transistors makes implementation as an integrated circuit easier and more reliable. The NTC component can be a bipolar transistor or a forward biased diode. Advantageously, the differential amplifier can be a folded cascode transconductance amplifier. However, if the input stage of such a differential amplifier is modified to provide an input related offset in the output, the voltage drop of a resistor coupled to the output of the amplifier can be reduced. The resistor can have a smaller resistance and the area required to implement the resistor can thus be reduced. Preferably, the offset can lie between 300 mV and 500 mV. Although the present invention is described mainly with respect to an NTC component, it also possible to implement the circuitry with a PTC component.

According to an aspect of the present invention, a method generates a current with a predetermined temperature coefficient. The method preferably includes the steps of providing a voltage across an NTC component, buffering the voltage across the NTC component using a buffering device having an input related offset so as to reduce an output voltage of the buffering device and applying the reduced output voltage across a resistor.

BRIEF DESCRIPTION OF THE DRAWINGS

These and other aspects of this invention are illustrated in the drawings, in which.

DETAILED DESCRIPTION OF PREFERRED EMBODIMENTS

Figure 1:
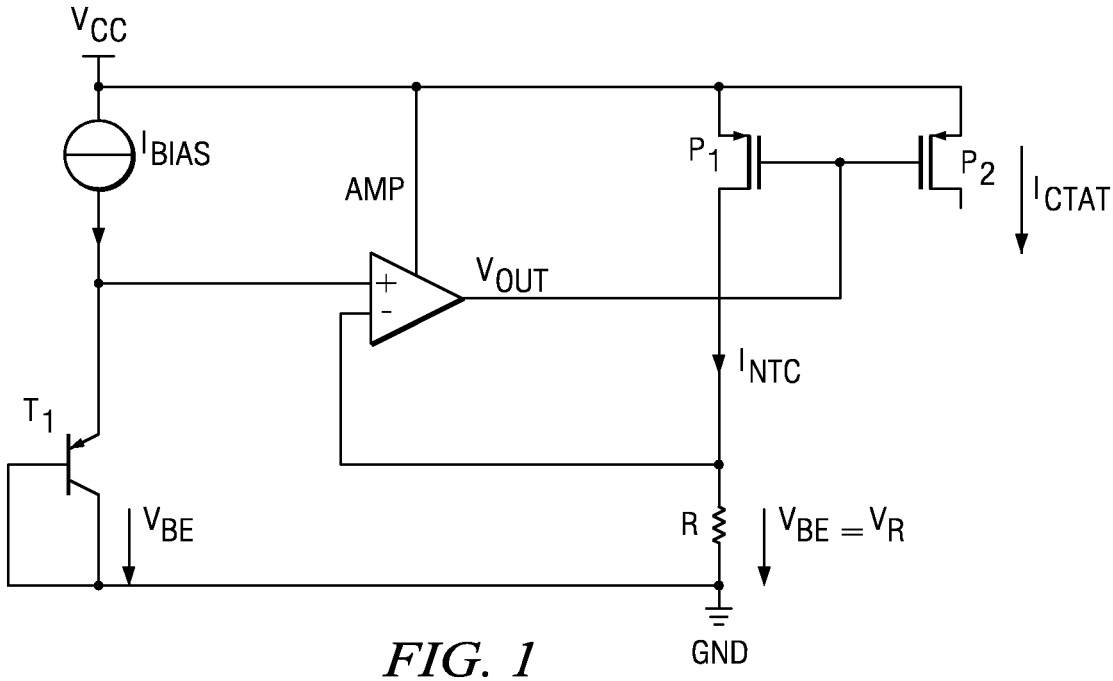
FIG. 1 (PRIOR ART)
FIG. 1 illustrates a simplified circuit diagram of an NTC current generator according to the prior art.

FIG. 1 shows a simplified block diagram of an NTC current generator according to the prior art. Bipolar transistor T1 has a base to emitter voltage $V_{BE}$. The transistor receives a bias current $I_{bias}$ from a constant current source. The base to emitter voltage $V_{BE}$ is coupled to the positive input of a differential amplifier AMP. The output of the amplifier AMP is coupled to the gates of PMOS transistors $P_1$ and $P_2$. The source of PMOS transistor $P_1$ is coupled to a supply voltage $V_{CC}$ and its drain is coupled to the negative input of the amplifier AMP and a resistor R. Due to the feedback connection of the amplifier AMP, the base to emitter voltage $V_{BE}$ of bipolar transistor T1 also appears across resistor R. The output current $I_{CTAT}$ at PMOS transistor $P_2$ is used for further biasing purposes having the desired temperature coefficient (TC). The TC of the output current $I_{CTAT}$ can be negative. However, the NTC can also be partially compensated or completely compensated by a PTC of the resistor R. The area of the resistance can be reduced by reducing the voltage across the resistor R. However, since $V_{BE}$ is technology dependent and not easily reduced, there is a need for a different solution as provided by the present invention.

Figure 2:
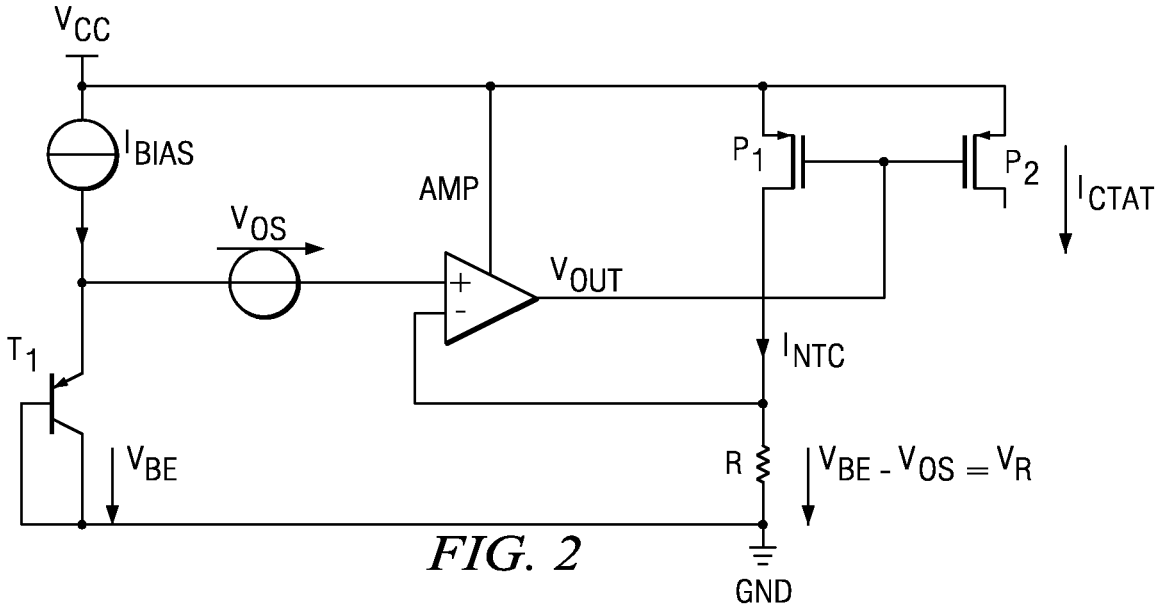
FIG. 2 illustrates a simplified circuit diagram of a first embodiment of the present invention.

FIG. 2 shows a simplified circuit diagram of an embodiment of the present invention. The circuit includes mostly the same components as the prior art circuit shown in FIG. 1. This invention includes voltage source $V_{OS}$ at the positive input of the differential amplifier AMP. As with the circuit shown in FIG. 1, bipolar transistor T1 is biased by the bias current source $I_{bias}$. Accordingly, the sum of the base to emitter voltage $V_{BE}$ and the offset voltage $V_{OS}$ appears at the positive input node of the differential amplifier. As a consequence of the feedback connection at the output of the amplifier AMP, the voltage drop across the resistor R is reduced by the offset voltage $V_{OS}$ at the positive input of the amplifier AMP. Due to this offset and the reduced voltage drop across the resistor R, the resistance of resistor R can be reduced. This reduction in resistance permits a reduction in the required chip area for the resistor R. However, the temperature behavior of the output current $I_{CTAT}$ is the same as for the prior art circuit of FIG. 1.

Figure 3:
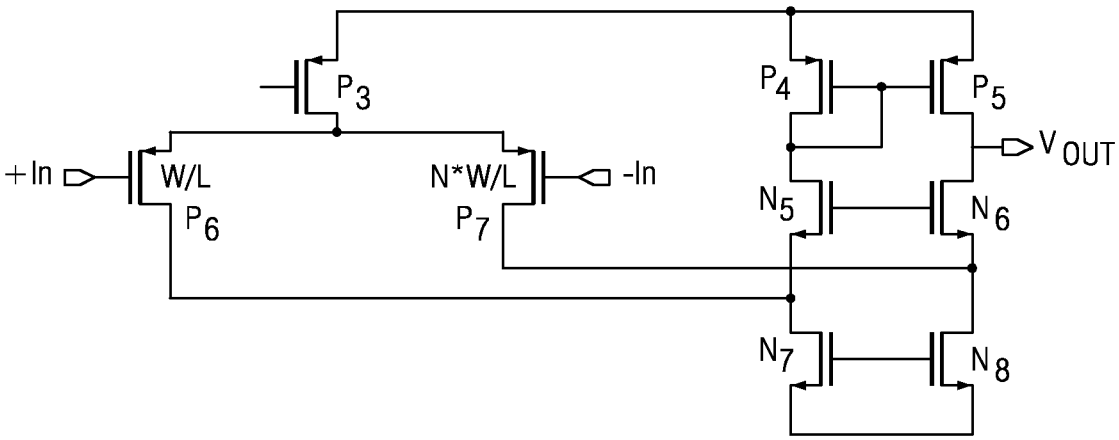
FIG. 3 illustrates a simplified circuit diagram of an amplifier according to an aspect of the present invention.

FIG. 3 shows a simplified circuit diagram of a differential amplifier according to an aspect of the present invention. FIG. 3 illustrates a folded cascode transconductance amplifier including a differential input stage having two PMOS transistors P6 and P7. The input transistors P6 and P7 have different dimensions, the width of the PMOS transistor P7 is N times the width of the PMOS transistor P6. This introduces an offset into the operational amplifier, as indicated in the FIG. 2 by independent voltage source $V_{OS}$. This folded cascode operational amplifier can preferably be used as the differential amplifier AMP of FIG. 2. The remaining transistors P4, P5, N5, N6, N7 and N8, as well as P3, are dimensioned as usual for this type of operational amplifier. A particular advantage of the folded cascode configuration is a small output offset and inherent stability, which make the folded cascode operational amplifiers particularly useful for integrated circuit design. Dimensioning the input stages as indicated in FIG. 3 with a preferably integral factor of N is easy to implement and allows a precisely predetermined desired offset.

Table 1 shows the exemplary area savings using the circuit of FIG. 3 in an arbitrary CMOS technology.

TABLE 1

| | Area in $\mu m^2$ | | | |
|---|---|---|---|---|
| Total $I_{DD}$ in nA | Operational Amplifier without offset | Operational Amplifier with 370 mV offset | Absolute Saving | Relative Saving |
| 20 | 131000 | 107000 | 24000 | 18% |
| 30 | 30000 | 25000 | 5000 | 17% |
| 40 | 17000 | 15000 | 2000 | 12% |
| 100 | 5500 | 4800 | 700 | 13% |

For this example, the base emitter voltage $V_{BE}$ is 450 mV and the offset voltage $V_{OS}$ is 370 mV. The total supply current $I_{DD}$ includes 10 nA output current ($I_{CTAT}$) and 7 nA amplifier current. The area includes the area for the bipolar transistor which is 1,000 $\mu m^2$. Accordingly, the resistor area can be reduced by up to about 20%. There are many different ways to introduce an offset into a differential amplifier. FIG. 3 illustrates one possibility where the input transistors have different dimensions. However, the output transistors in the two branches can also have different dimensions.

Figure 4:
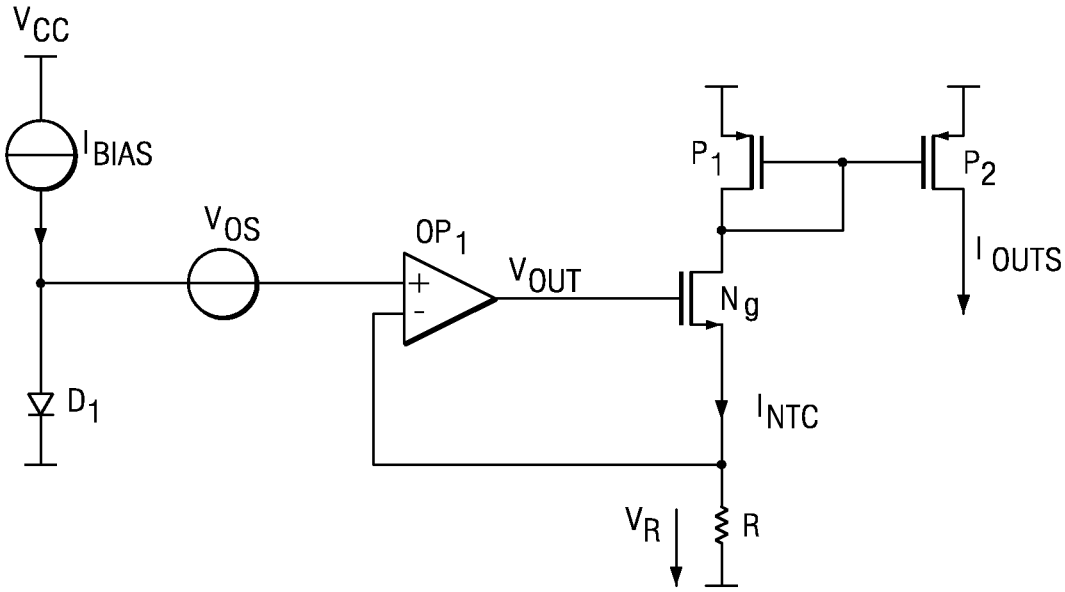
FIG. 4 illustrates a simplified circuit diagram of a second preferred embodiment of the present invention.

FIG. 4 illustrates a simplified circuit diagram of another preferred embodiment of the present invention. A forward biased diode D1 is used to provide a voltage level with a negative temperature coefficient. As in FIG. 2, the operational amplifier OP1 has an additional offset voltage source $V_{OS}$ coupled to its positive input. However, the feedback connection at the output of OP1 is different. The output of operational amplifier OP1 is directly coupled to the gate of NMOS transistor N9. The voltage between the source of N9 and resistor R is coupled to the negative input of the differential amplifier OP1. The PMOS transistors P1 and P2 are coupled in a current mirror configuration to provide an output current $I_{OUTS}$. The circuit of FIG. 4 provides the same advantages as set out with respect to FIG. 3.

Although the present invention was mainly described with respect to a NTC component, the NTC component can generally be replaced by a PTC component, which has a constant voltage drop.

What is claimed is:

1. An electronic device comprising circuitry for generating a current with a predetermined temperature coefficient (TC) comprising:

a bias current source ($I_{bias}$);

an TC component (T1) receiving the bias current ($I_{bias}$);

a resistor (R);

a current source (P1, P2) supplying current ($I_{NTC}$) to the resistor (R); and a differential amplifier (AMP) having a positive input receiving a voltage across the TC component (T1), a negative input receiving a voltage across the resistor (R) and an output controlling the current source (P1, P2), the differential amplifier (AMP) having a predetermined input related offset ($V_{OS}$) on the positive input to decrease the voltage drop ($V_R$) across the resistor (R), said differential amplifier (AMP) having a differential input stage including a first input MOSFET transistor connected to the positive input having a first width/length ratio, and a second input MOSFET transistor connected to the negative input having a second width/length ratio different from the first width/length ratio selected to provide the input related offset ($V_{OS}$).

2. The electronic device according to claim 1, wherein: the second width/length ratio is an integral N times the first width/length ratio.

3. The electronic device according to claim 1, wherein: the TC component is a bipolar transistor (T1).

4. The electronic device according to claim 1, wherein: the TC component is a forward bias diode (D1).

5. The electronic device according to claim 1, wherein: the differential amplifier (AMP) is a folded cascode transconductance amplifier.

6. The electronic device according to claim 1, wherein: the offset voltage ($V_{OS}$) is between 300 mV and 500 mV.

7. An electronic device comprising circuitry for generating a current with a predetermined temperature coefficient (TC) comprising:

a bias current source ($I_{bias}$);

an TC component (T1) receiving the bias current ($I_{bias}$);

a differential amplifier (AMP) having a positive input receiving a voltage across the TC component (T1), a negative input and an output, said differential amplifier (AMP) having a predetermined input related offset ($V_{OS}$) on the positive input;

a current source (P1, P2, Ng) connected to said output of said differential amplifier (AMP) supplying a current ($I_{NTC}$), said current source (P1, P2, Ng) including a first MOS transistor (Ng) having a gate connected to said output of said differential amplifier (AMP), a source and a drain supplying said current ($I_{NTC}$), a second MOS transistor (P1) having a source connected to a supply voltage, a drain and a gate connected to said source of said first MOS transistor, a third MOS transistor (P2) having a source connected to a supply voltage, a gate connected to said source of said first MOS transistor and a drain; and a resistor (R) connected to said drain of said first MOS transistor receiving said current ($I_{NTC}$), said negative input of said differential amplifier (AMP) receiving a voltage across said the resistor (R).

8. The electronic device according to claim 7, wherein: the TC component is a bipolar transistor (T1).

9. The electronic device according to claim 7, wherein: the TC component is a forward bias diode (D1).

10. The electronic device according to claim 7, wherein: the differential amplifier (AMP) is a folded cascode transconductance amplifier.

11. The electronic device according to claim 7, wherein: the offset voltage ($V_{OS}$) of said offset voltage source is between 300 mV and 500 mV.

* * * * *